United States Patent [19]

Pearson

[11] 4,344,194

[45] Aug. 17, 1982

[54] TOILET SEAT AND LID UNIT WITH CONCEALED AIR DEODORIZER

[76] Inventor: Raymond H. Pearson, 627 Sherwood Dr., Richardson, Tex. 75080

[21] Appl. No.: 215,801

[22] Filed: Dec. 12, 1980

[51] Int. Cl.[3] ..... E03D 9/04

[52] U.S. Cl. ..... 4/213; 4/217; 4/229; 4/230

[58] Field of Search ..... 4/209, 209 FF, 213, 4/216, 217, 229, 249, 347, 348, 230

[56] References Cited

U.S. PATENT DOCUMENTS

| | | | |
|---|---|---|---|
| 2,846,696 | 8/1958 | Herriott | 4/213 |
| 2,849,727 | 9/1958 | Bollinger et al. | 4/217 |
| 3,087,168 | 4/1963 | Huso | 4/213 |
| 3,230,551 | 1/1966 | Kopp | 4/213 |
| 3,659,296 | 5/1972 | Stamper | 4/217 |
| 3,689,944 | 9/1972 | Clayton | 4/213 |
| 3,763,505 | 10/1973 | Zimmerman | 4/213 |
| 3,790,970 | 2/1974 | Bendersky et al. | 4/213 X |
| 3,913,150 | 10/1975 | Poister et al. | 4/213 |
| 3,916,459 | 11/1975 | Ivanceric | 4/213 |
| 4,153,956 | 5/1979 | Fischer, Sr. et al. | 4/213 |
| 4,166,298 | 9/1979 | Pearson | 4/213 |

*Primary Examiner*—Henry K. Artis

*Attorney, Agent, or Firm*—LeBlanc, Nolan, Shur & Nies

[57] ABSTRACT

A toilet seat and lid assembly having air ventilating and deodorizing equipment concealed in the lid, and one or more air passages extending through the seat in seriatim with one or more air conduits providing air communication between the closet bowl and an air chamber which houses the air ventilating and deodorizing equipment in the lid, whereby such equipment is effective to remove odorous air in the bowl, and to deodorize the removed air before expelling it to the ambient atmosphere when the toilet is in use.

6 Claims, 4 Drawing Figures

TOILET SEAT AND LID UNIT WITH CONCEALED AIR DEODORIZER

FIELD OF INVENTION

This invention relates to a novel toilet seat and air deodorizing unit in which air deodorizing and ventilation apparatus is concealed in the toilet seat lid.

BACKGROUND

Prior to my invention, various air deodorizing and ventilating devices have been proposed for removing odor laden air from an upwardly opening toilet closet bowl, and for deodorizing the odor ladened air before it is discharged into the atmosphere. Representative teachings of such prior proposals are found in the following U.S. patents: U.S. Pat. No. 2,846,696 issued on Aug. 12, 1958 to J. R. Herriott; U.S. Pat. No. 3,087,168 issued on Apr. 30, 1963 to M. A. Huso; U.S. Pat. No. 3,230,551 issued on Jan. 25, 1966 to R. A. Kopp; U.S. Pat. No. 3,689,944 issued on Sept. 12, 1972 to C. R. Clayton; U.S. Pat. No. 3,763,505 issued on Oct. 9, 1973 to J. P. Zimmerman; U.S. Pat. No. 3,790,970 issued on Feb. 12, 1974 to D. Bendersky et al.; U.S. Pat. No. 3,913,150 issued on Oct. 21, 1975 to C. E. Poister et al.; and my own U.S. Pat. No. 4,166,298 issued on Sept. 4, 1979.

Most of the foregoing patents disclose toilet ventilating devices having unsightly external appendages. Such exterior parts, aside from having a negative impact on appearance, are troublesome to keep clean and sanitary.

Some of the foregoing devices cannot be retrofit to all conventional toilets. For example, my own patent teaches a deodorizer unit which can only be adapted to toilets having a water tank and an overflow conduit.

The Clayton patent discloses a deodorizing apparatus which does not have the aforementioned disadvantages. However, this device has limited effectiveness owing to the intrinsic nature of the rear extension of the lid, which extension serves as an air duct when the lid is raised. The rear extension necessarily lies to the rear of the toilet seat, and is quite removed from the interior of the toilet bowl.

All of the foregoing patents disclose devices which have the disadvantage that they operate each time the toilet is used, whether or not deodorization is needed or desired. In a battery operated device, such as I propose, this greatly reduces the time between battery charging or battery replacement. Furthermore, this greatly reduces the life expectancy of the fan motor.

SUMMARY AND OBJECTS OF INVENTION

My invention has none of the foregoing drawbacks and retains the advantage of a self-contained toilet seat and lid unit incorporating a concealed air ventilating and deodorizing apparatus.

According to my invention, at least one air passage is formed through the toilet seat itself, and has an inlet end opening directly into the closet bowl when the seat is in its lowered position. The toilet seat lid is formed with an interior air chamber space for receiving the concealed deodorizing and ventilating equipment, which comprises a motor driven fan and an air deodorizing filter. Air communication is provided between the air passage in the seat and the air chamber in the lid by way of at least one air conduit between the seat and the lid.

In a preferred specific embodiment of this invention, the novel air conduit between the seat and the lid comprises hollow pintles or pivot pins which also serve to pivotally mount the seat and lid for swinging movement between their raised and lowered positions. Operation of the concealed fan in the lid induces air in the closet bowl to flow in seriatim through the air passage in the seat, through either or both hollow pintles, through the concealed air deodorizer filter in the lid's interior air chamber space, and out into the surrounding atmosphere by way of one or more vents or discharge openings in the lid.

A novel electrical control for toilet deodorizers is also provided. The control comprises a switch having one weight-responsive operator, located in the toilet seat and responsive to the weight of a person seated on the seat, and one manually operated operator at a convenient location on the seat and lid assembly. If the weight-responsive operator is operated, due to the weight of a person seated on the seat, then the fan may be turned on by momentarily operating the manually operated operator. When the person's weight is removed from the seat, the fan is automatically turned off. The fan will not turn on in response to the operation of only one of the operators.

With the foregoing in mind, the general aim and purpose of this invention is to provide a novel air ventilating and deodorizing toilet seat and lid unit which has none of the previously mentioned drawbacks of the prior art constructions, but which retains the advantages of a self-contained construction, in which the air ventilating and deodorizing apparatus are concealed in the toilet seat lid.

In particular, it is an object of this invention to provide a novel air ventilating and deodorizing toilet seat and lid assembly having at least one air conduit between the seat and lid so that air may be induced from the bowl through an air passage formed in the seat into an air chamber formed in the lid.

Another object of this invention is to provide a novel air ventilating and deodorizing toilet seat and lid assembly which may be optionally turned on, and which turns off automatically.

Still another object of this invention is to provide a novel air ventilating and deodorizing toilet seat and lid assembly which is economical to manufacture, easy to install, easy to use, effective, and which fits all toilets which have a standard toilet seat.

Further objects of this invention will appear as the description proceeds in connection with the below-described drawings and appended claims.

DETAILED DESCRIPTION

Figure 1:
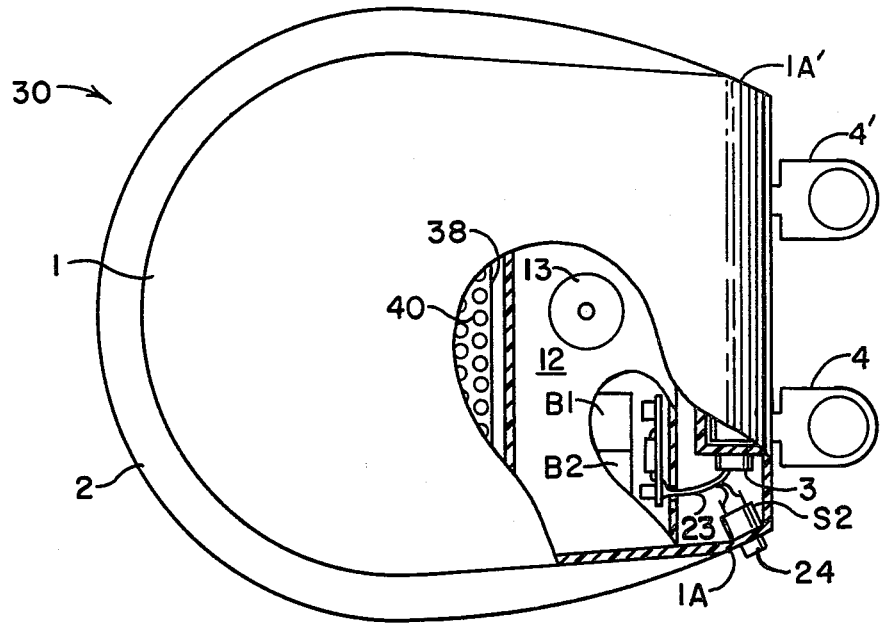
FIG. 1 is a top plan view of an air ventilating and deodorizing toilet seat and lid assembly according to a preferred specific embodiment of my invention.
Figure 2:
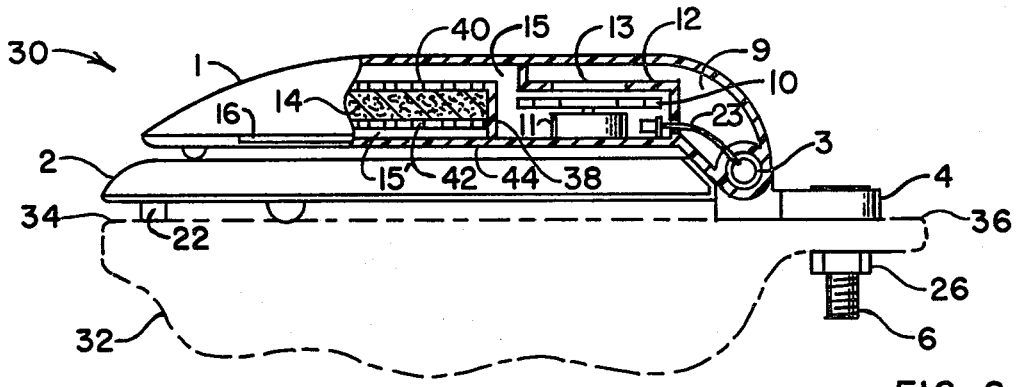
FIG. 2 is a side elevation of the assembly shown in FIG. 1 with a portion of the lid's exterior wall broken away to illustrate interior details.
Figure 3:
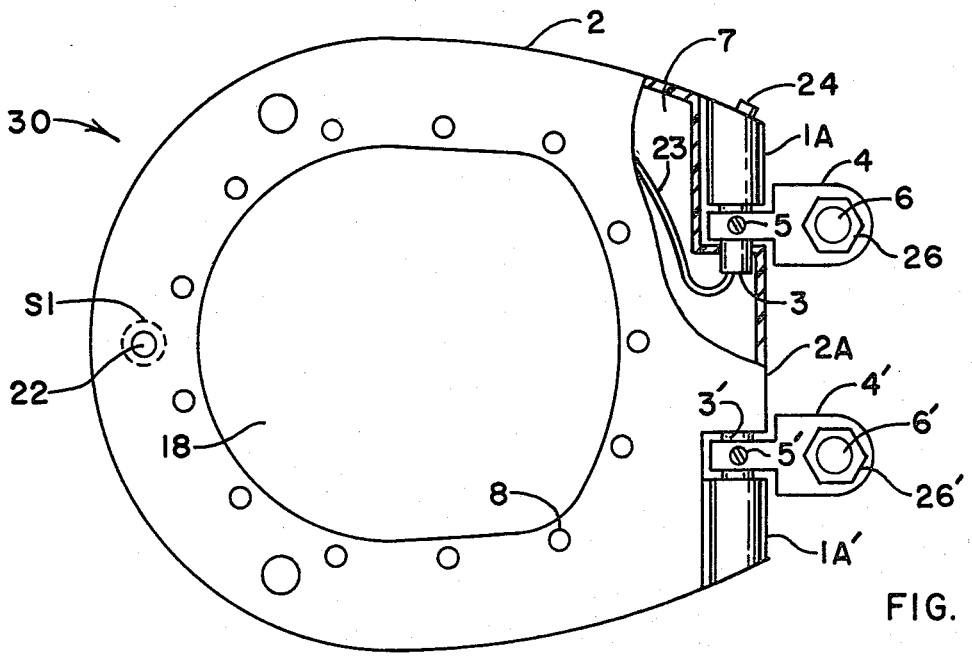
FIG. 3 is a bottom plan view of the assembly shown in FIGS. 1 and 2 with a portion of the seat's exterior wall broken away to illustrate interior details.

In the embodiment shown in FIGS. 1–3, the air-deodorizing and toilet seat and lid unit or assembly incorporating the principles of my invention is generally indicated at 30 and mainly comprises a hollow toilet seat 2 and a hollow toilet seat lid 1 for seat 2. Assembly 30 is specifically adapted for use with a conventional closet or toilet bowl 32 (see FIG. 2). Bowl 32 is in the form of an upwardly opening receptacle terminating in a flat upwardly facing peripheral rim 34.

Lid 1 and seat 2 are hinged on a common pair of short, hollow pintles or pivot pins 3,3'. Pintles 3, 3' are mounted in hinges 4, 4' respectively, and are held in place in their respective hinges by small set screws 5, 5'. Hinge 4 is detachably fixed to the rearwardly directed ledge 36 of bowl 32 by a bolt 6 and nut 26. Hinge 4' is similarly detachably fixed to the ledge portion 36 of bowl 32 by a bolt 6' and a nut 26'.

As shown, pintles 3 and 3' are arranged in axially-aligned spaced-apart relationship at the rear of bowl 32. The aligned axes of pintles 3, 3' extend horizontally. Both ends of pintle 3 extends axially beyond a mounting portion of hinge 4. Likewise, pintle 3' extends axially at both ends beyond the mounting portion of hinge 4'.

Lid 1 is formed at its rearward end with spaced-apart down-turned lugs 1A and 1A' which pivotally receive the outwardly extending end portions of pintles 3, 3', respectively. By this arrangement lid 1 is hinged or pivotally mounted on the pintles for swinging movement about the horizontally aligned axes of pintles 3, 3'. As shown, lugs 1A and 1A' are disposed laterally outwardly of the pintle mounting portions of hinges 4, 4'.

Seat 2 is formed at its rear with a lug 2A which lies between hinges 4, 4' and which rotatably or pivotally receives the inwardly-directed end portions of pintles 3, 3' to thus hinge seat 2 on the pintles.

By the foregoing construction it will be appreciated that lid 1 and seat 2 are pivotally mounted about a common horizontally-extending axis for swinging movement between their customary raised and lowered positions. Lid 1 and seat 2 are shown in FIGS. 1 and 2 to be in their lowered positions. Both the lid and seat are swingable in a clockwise direction as viewed from FIG. 2 to their raised positions where they extend generally upwardly from the rear of bowl 32. Lid 1 overlies and rests on seat 2 to cover the central opening in seat 2 when both the lid and seat are in their lowered, horizontally-extending positions.

Seat 2 has the customary central opening 18, and is formed with one or more air ducts of passages 8. Air passages 8 open at their air inlet ends into bowl 32, and are thus in air communication with the interior of bowl 32. The air discharge ends of passages 8 open into the hollow interior 7 of seat 2. As shown, the inner open ends of pintles 3, 3' extend into the hollow interior 7, and are thus in air communication with the hollow interior 7.

The hollow interior of lid 1 defines an air chamber space which is partitioned by an interior wall or bulkhead 12 into an air intake compartment 9 and an air discharge compartment 15. The air intake compartment 9 extends into the region of the lid's lugs 1A and 1A' such that the outwardly directed end portions of pintles 3, 3' open into and hence are in air communication with air intake compartment 9.

From the description thus far it will be appreciated that the inner ends of pintles 3, 3', which open inwardly towards each other, open into the hollow interior 7 of seat 2. The opposite ends of pintles 3, 3', which open laterally outwardly, open into the air intake compartment 9 in lid 1. Accordingly, pintles 3, 3' establish air communication between air passages 8 and air intake compartment 9. Other means establishing air communication may be employed between the air passages 8 and the air chamber 9, in lieu of the hollow pintles 3, 3'.

As shown in FIG. 2, a thin, low-profile centrifugal fan 10, a relatively flat low-profile electric motor 11 and an air deodorizing filter 14 are received in the air discharge compartment 15. Motor 11 may be mounted on the bottom wall of lid 1. Fan 10 is non-rotatably mounted on the motor's drive or output shaft in alignment with an air inlet aperture 13 which is formed through the interior partition wall 12. Operation of fan 10 causes air in the air inlet compartment 9 to flow through aperture 13 into the air discharge compartment 15.

Filter 14 may be of any suitable type such as an activated charcoal filter which is contained in an internal housing 38. Housing 38 is formed internally in lid 1 forwardly of the fan and motor assembly and has upper air inlet apertures 40 and lower air outlet apertures 42. Housing 38 further defines an air outlet compartment 15' below outlet apertures 42. The air outlet openings 42 at the discharge end of the filter 14 open into the air outlet compartment 15', and the air inlet openings 40 open into compartment 15. Housing 38 partitions compartment 15 from compartment 15' in such a way that the only path for air to flow from compartment 15 to compartment 15' is through filter 14.

At least one exit aperture or vent 16 is formed through an exterior wall of lid 1 and communicates interiorly only with the air outlet compartment 15'. Vent 16 is formed along the lower side edge of lid 1 and opens laterally outwardly into the ambient atmosphere exteriorly of lid 1.

From the construction thus far described, it will be appreciated that when fan 10 is placed in operation by energizing motor 11, it will reduce the air pressure in the intake compartment 9 below ambient pressure. Odorous air in bowl 32 is therefore induced to flow in seriatim through air passages 8, hollow interior 7, pintles 3, 3', intake compartment 9, and aperture 13 to fan 10. This odorous air is forced by fan 10 to flow through compartment 15, filter 14, compartment 15' and vent 16 into the ambient atmosphere. Because filter 14 is in seriatim with fan 10, all of the air discharged by fan 10 will be forced through filter 14 before it passes out into the ambient atmosphere by way of vent 16. Deodorized air will therefore be discharged from compartment 15' through vent 16 into the surrounding ambient atmosphere.

In the normal use of the apparatus described above, the lid 1 is normally swung to or placed in its raised position allowing a person to sit on seat 2, and fan 10 is placed in operation by energizing motor 11. Odorous air in bowl 32 will therefore flow in the manner previously described through the air passageways 8 in seat 2 through the filter 14 in lid 1 to provide for the discharge of deodorized air to the ambient atmosphere exteriorly of the lid and seat assembly.

In the embodiment shown in FIGS. 1–3, a push button receprocal operator 22 is mounted in seat 2 and is responsive to the weight of a person seated on seat 2. A second push button reciprocal operator 24 is mounted in lug 1A of lid 1, and is conveniently operable by a person seated on seat 2. If a person is seated on seat 2, then, and only then, momentarily depressing operator 24 will close the circuit to energize motor 11. When the person rises from seat 2, the circuit to motor 11 opens, de-energizing the motor. It will be appreciated that with this novel control for toilet deodorizers, the ventilating and deodorizing equipment may be operated only when there is a need for it, and not each time the toilet is used, as in the prior art.

Figure 4:
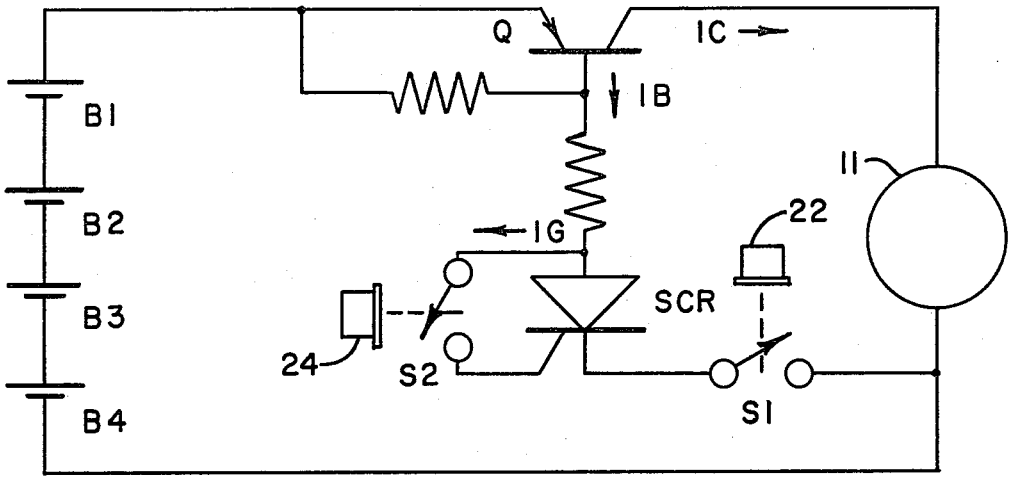
FIG. 4 is a schematic diagram of the electrical portion of the toilet seat and lid assembly shown in FIGS. 1, 2 and 3.

Referring to the schematic diagram FIG. 4, batteries B1–B4 provide the electrical energy for the motor 11 and the control circuit. The control circuit comprises a normally-open motor switching means germanium transistor Q, a first operator 22 in conjunction with a normally open momentary switch S1, a second operator 24 in conjunction with a normally open momentary switch S2, and a coacting means thyrister SCR. First operator 22 and switch S1 are responsive to the weight of a person seated on seat 2. Second operator 24 and switch S2 are responsive to manual operation by a person seated on seat 2. When a person is seated on seat 2, switch S1 closes, but transistor Q remains non-conductive (open). If with switch S1 closed operator 24 is momentarily operated to close switch S2, the thyristor SCR will switch to a conducting state, owing to the application of gate current IG. A relatively high base current IB will now flow through transistor Q and thyrister SCR, causing transistor Q to conduct a high collector current IC through motor 11. The thyrister SCR and transistor Q will remain conductive until there is no longer a person seated on seat 2, at which time switch S1 opens, and thyrister SCR and transistor Q revert to non-conducting states, de-energizing motor 11.

It will be appreciated that many equivalent control circuits and mechanisms may be constructed by those skilled in the art. These include the simplest normally-open mechanical switch having first and second mechanical operators 22, 24 and mechanical coacting means functioning as described above.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A toilet seat and air deodorizing unit for an upwardly opening water closet bowl, comprising a toilet seat adapted to be positioned on said bowl and pivotally mounted about a horizontal axis at the rear of said bowl for swinging movement between raised and lowered positions, a toilet seat lid pivotally mounted independently of said seat for swinging movement about a horizontal axis at the rear of said bowl, enabling said lid to be swung between a lowered position where it covers the central opening in said seat and a raised position where it is raised from the seat, said seat being formed with at least one air passage having an open air intake end located to open into and to be in air communication with the interior of said bowl, said lid having a hollow, interior, air chamber space and at least one air discharge vent opening into said interior space and establishing air communication between said interior space and the ambient atmosphere exteriorly of said lid and said bowl, there being means establishing air communication between said interior space and said air passage remote from said air intake end for establishing air communication between the interior of said bowl and the ambient atmosphere by way of said air passage, said interior space and said vent in seriatim, a motor-driven fan mounted in said space between said means and said vent for inducing the flow of air from said bowl to the ambient atmosphere by way of said air passage, said means, said interior space and said vent in seriatim, and an air-deodorizing filter mounted in said interior space in seriatim with said fan for removing odors from the air induced from said bowl by said fan and to thereby provide for the discharge of deodorized air through said vent to the ambient atmosphere outside said bowl and said lid, said means comprising at least one hollow, horizontally mounted pintle on which said lid and said seat are pivotally mounted for swinging movement between their raised and lowered positions, said pintle being open to said air passage and to said interior space to establish air communication between said air passage and said space.

2. The toilet seat and air deodorizing unit defined in claim 1 including a support member mounting said pintle and adapted to be fixed to said bowl, said pintle extending at both ends axially beyond said support member and being open at both ends, said seat having a seat lug (a) receiving one of the open ends of said pintle to one side of said support member and (b) defining a portion of said air passage, said one of said ends of said pintle opening into said portion of said air passage, said lid having a rearwardly extending lug defining a portion of said interior chamber space and receiving the other of the ends of said pintle on the side of said support member opposite from said seat lug, the other of said ends of said pintle opening into said portion of said interior.

3. The toilet seat and air deodorizing unit defined in any one of the preceding claims 1 or 2 including an electric motor drive connected to said fan for operating said fan, said lid being formed with an interior wall partitioning said interior space into an air inlet compartment and an air outlet compartment, there being an aperture formed through said interior wall to establish air communication between said inlet and outlet compartments, said fan and said motor being disposed in said outlet compartment, and said fan being positioned adjacent to the aperture which is formed through said interior wall to induce the flow of air from the inlet compartment and through said outlet compartment, said vent opening into said outlet compartment at its inner end and opening outwardly to the ambient atmosphere at its outer end, and said filter being disposed in said outlet compartment between said fan and said vent.

4. In an air ventilating accessary for a toilet having a toilet bowl with a seat mounted thereto, said accessary including an electric motor drive connected to a fan for inducing odorous air from said bowl; control means therefor comprising (a) normally open siwtching means operable to close to complete the circuit to energize said motor, (b) a first operator responsive to the weight of a person seated on said seat, (c) a second operator responsive to manual operation by a person seated on said seat, and (d) coacting means whereby said first and second operators cooperate to close said switching means in response of said first operator to the weight of a person seated on seat and of said second operator to momentary manual operation by a person seated on said seat.

5. A toilet seat and air ventilating unit for an upwardly opening water closet bowl, comprising a toilet seat having a central opening, a toilet seat lid, means pivotally mounting said seat and said lid for swinging movement about a horizontal axis at the rear of said bowl and enabling said lid to be swung between a lowered position where it covers said central opening in said seat and a raised position where it is raised from the seat, said means pivotally mounting said seat and said lid comprising at least one part on which said seat and said lid are pivotally mounted, said seat being formed with at least one air passage having an open air intake end located to open into and to be in air communication with the interior of said bowl, said lid having a hollow, interior, air chamber space and at least one air discharge vent opening into said interior space and establishing air communication between said interior space and the ambient atmosphere exteriorly of said lid and said bowl, said part having a passageway establishing air communication between said interior space and said air passage remote from said air intake end, and a motor-driven fan mounted in said space for inducing the flow of air from said bowl to the ambient atmosphere by way of said air passage, said passageway, said interior space and said vent in seriatim.

6. An air ventilating unit for a toilet having a toilet bowl and a seat pivotally mounted on said bowl, said air ventilating unit comprising a fan for inducing odorous air from said bowl, an electric motor drive connected to said fan for operating said fan, and means for controlling operation of said motor and comprising first and second switch means, and further means electrically connected to said first and second switch means and to said motor, said first switch means being actuated to a first state in response to the weight of a person seated on said seat and to a second state in response to the removal of said weight from said seat, said second switch means being located to be selectively closed and opened by a person seated on said seat, and said further means being responsive to the closure of said second switch means to energize said motor only if said first switch means is in its first state at the time when said second switch means is closed and to maintain said motor energized as long as said first switch means remains in its first state even though said second switch means is opened before said first switch means is switched to its second state.

* * * * *